US011782358B2

(12) United States Patent
Mai

(10) Patent No.: US 11,782,358 B2
(45) Date of Patent: Oct. 10, 2023

(54) DEVELOPING AGENT FILLING DEVICE THAT RELEASES DEVELOPING ROLLER FROM PRESSURE OF REGULATION BLADE, AND DEVELOPING AGENT FILLING METHOD

(71) Applicant: KYOCERA Document Solutions Inc., Osaka (JP)

(72) Inventor: Dan Van Mai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/994,892

(22) Filed: Nov. 28, 2022

(65) Prior Publication Data

US 2023/0168604 A1 Jun. 1, 2023

(30) Foreign Application Priority Data

Nov. 30, 2021 (JP) ..... 2021-194155

(51) Int. Cl.
*G03G 15/08* (2006.01)

(52) U.S. Cl.
CPC ..... *G03G 15/0812* (2013.01); *G03G 15/0889* (2013.01)

(58) Field of Classification Search
CPC ..... G03G 15/0812; G03G 15/0865; G03G 15/0889; G03G 15/0894; G03G 21/1821
See application file for complete search history.

(56) References Cited

U.S. PATENT DOCUMENTS

2014/0270843 A1* 9/2014 Acquaviva ..... G03G 15/0894 399/109
2019/0002141 A1* 1/2019 Aoki ..... G03G 15/0894

FOREIGN PATENT DOCUMENTS

| | | | |
|---|---|---|---|
| JP | H04465 | A | 1/1992 |
| JP | H0527579 | A | 2/1993 |
| JP | H0683172 | A | 3/1994 |
| JP | H06342238 | A | 12/1994 |

* cited by examiner

*Primary Examiner* — Hoang X Ngo
(74) *Attorney, Agent, or Firm* — IP BUSINESS SOLUTIONS, LLC

(57) ABSTRACT

A developing agent filling device includes a jig retaining a developing device with a filling inlet oriented upward, the developing device including a stirring chamber, a bladed wheel that stirs a developing agent stored in the stirring chamber, a developing roller that retains the developing agent stirred by the bladed wheel, the filling inlet located at an end portion of the stirring chamber in an axial direction of the bladed wheel and opened in the axial direction, a support member supporting a shaft of the bladed wheel inside of the filling inlet, a regulation blade opposed to an outer circumferential surface of the developing roller, and a biasing member that presses the regulation blade against the developing roller, a pressure relief device that releases the developing roller from a pressure of the regulation blade, against the biasing member, and a vibration generating device that vibrates the developing device.

7 Claims, 12 Drawing Sheets

DEVELOPING AGENT FILLING DEVICE THAT RELEASES DEVELOPING ROLLER FROM PRESSURE OF REGULATION BLADE, AND DEVELOPING AGENT FILLING METHOD

INCORPORATION BY REFERENCE

This application claims priority to Japanese Patent Application No. 2021-194155 filed on Nov. 30, 2021, the entire contents of which are incorporated by reference herein.

BACKGROUND

The present disclosure relates to a developing agent filling device that fills a developing device with a developing agent, and to a developing agent filling method.

An image forming apparatus based on electrophotography includes a developing device that develops a latent image with a developing agent. The developing device includes a bladed wheel that stirs the developing agent stored in a stirring chamber, a developing roller opposed to a photoconductor drum, to retain the stirred developing agent, and a regulation blade that regulates the layer thickness of the developing agent retained by the developing roller. In general, the regulation blade is pressed against the developing roller.

SUMMARY

The disclosure proposes further improvement of the foregoing techniques.

In an aspect, the disclosure provides a developing agent filling device including a jig, a pressure relief device, and a vibration generating device. The jig retains a developing device with a filling inlet oriented upward, the developing device including a stirring chamber, a bladed wheel that stirs a developing agent stored in the stirring chamber, a developing roller that retains the developing agent stirred by the bladed wheel, the filling inlet located at an end portion of the stirring chamber in an axial direction of the bladed wheel and opened in the axial direction, a support member supporting a shaft of the bladed wheel inside of the filling inlet, a regulation blade opposed to an outer circumferential surface of the developing roller, and a biasing member that presses the regulation blade against the developing roller. The pressure relief device releases the developing roller from a pressure of the regulation blade against the biasing member. The vibration generating device vibrates the developing device.

In another aspect, the disclosure provides a developing agent filling method including mounting a developing device on a jig with a filling inlet oriented upward, the developing device including a stirring chamber, a bladed wheel that stirs a developing agent stored in the stirring chamber, a developing roller that retains the developing agent stirred by the bladed wheel, the filling inlet located at an end portion of the stirring chamber in an axial direction of the bladed wheel and opened in the axial direction, a support member supporting a shaft of the bladed wheel inside of the filling inlet, a regulation blade opposed to an outer circumferential surface of the developing roller, and a biasing member that presses the regulation blade against the developing roller, releasing the developing roller from a pressure of the regulation blade using a pressure relief device, against the biasing member, and filling the developing device with the developing agent through the filling inlet, while vibrating the developing device using a vibration generating device.

DETAILED DESCRIPTION

Hereafter, a printer 1 (an example of an image forming apparatus) according to an embodiment of the disclosure will be described, with reference to the drawings.

Figure 1:
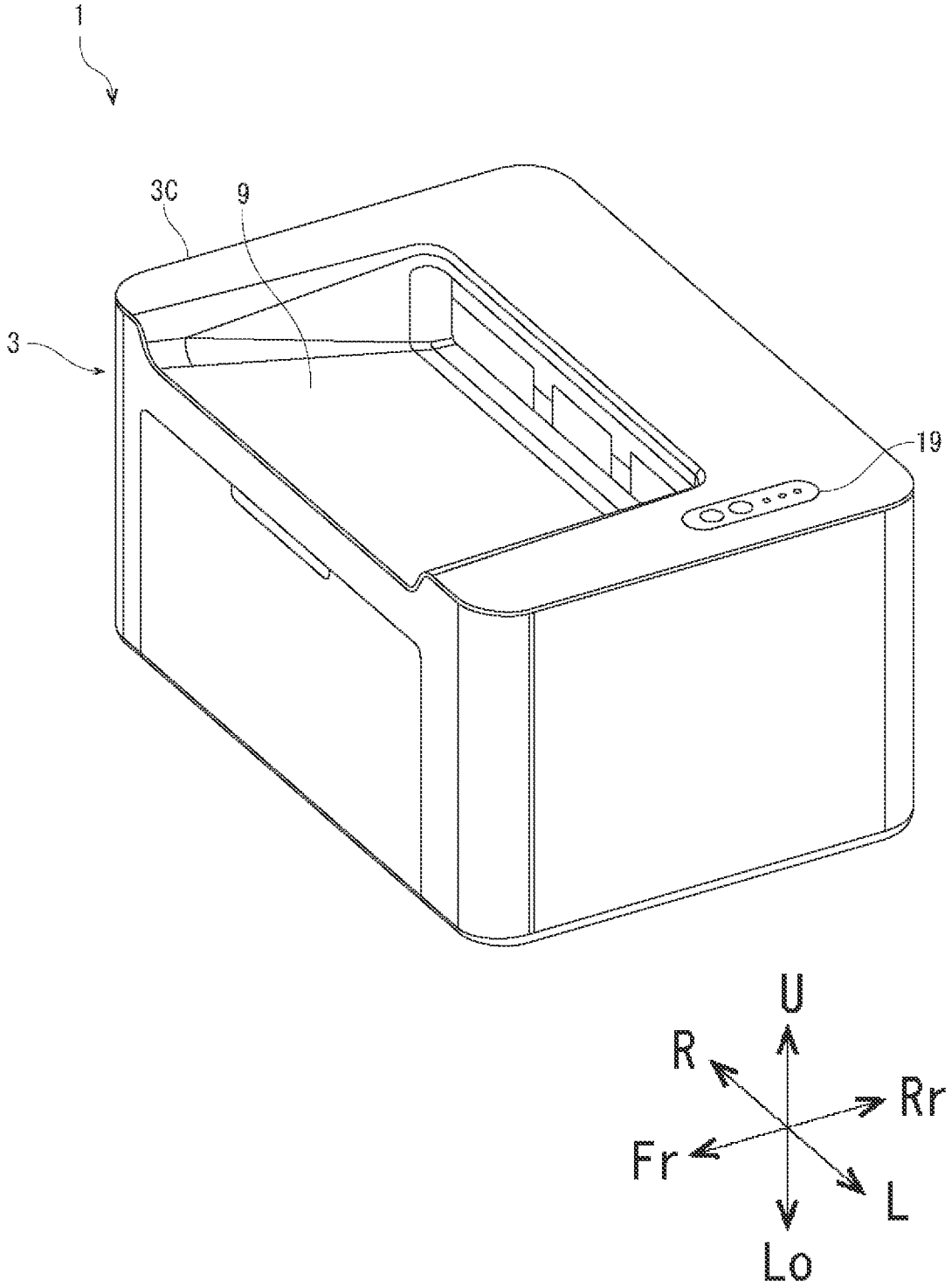
FIG. 1 is a perspective view showing the appearance of a printer.
Figure 2:
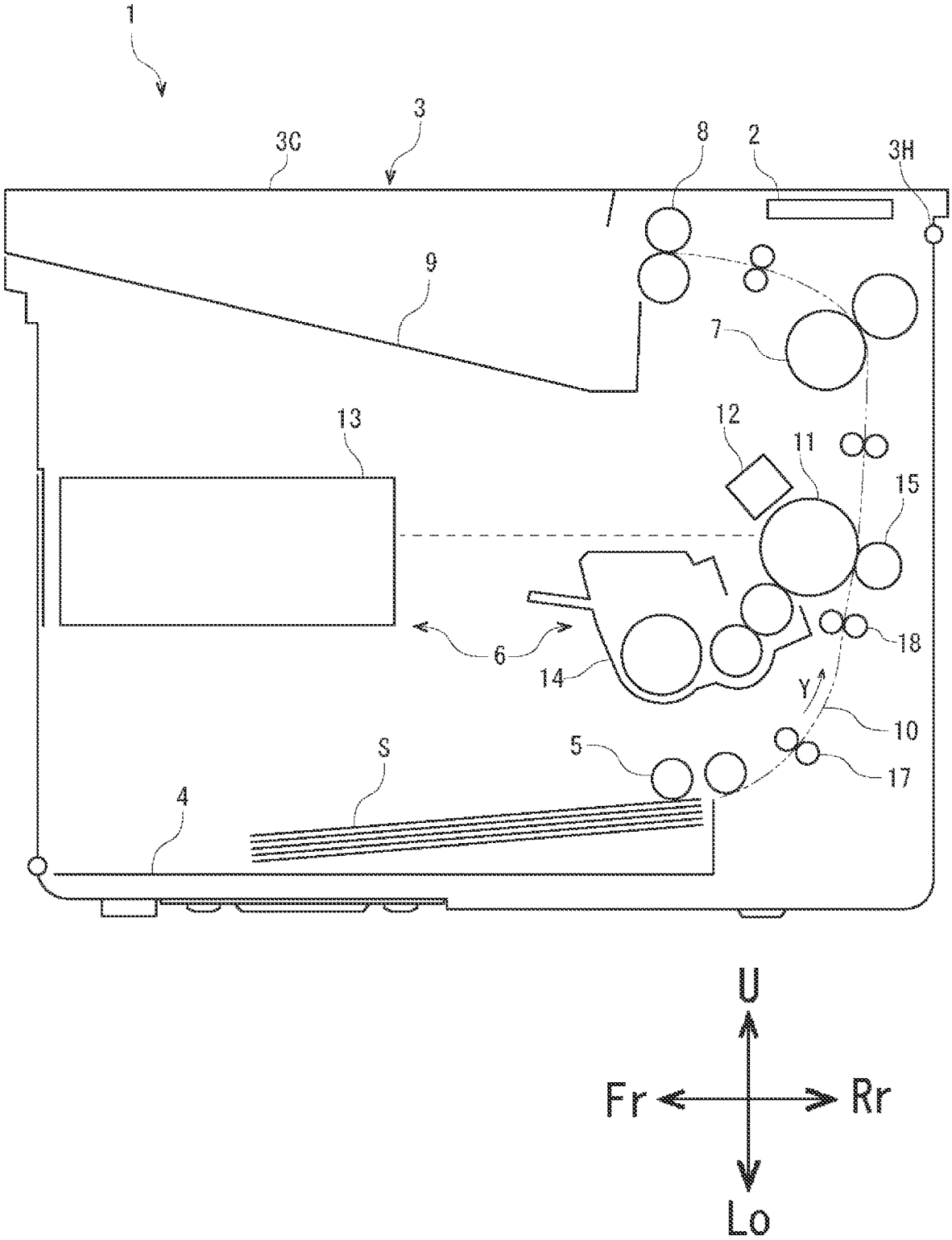
FIG. 2 is a left side view schematically showing an internal configuration of the printer.

First, a general configuration of the printer 1 will be described. FIG. 1 is a perspective view showing the appearance of the printer 1. FIG. 2 is a left side view schematically showing an internal configuration of the printer 1. The side indicated by "Fr" in FIG. 1 and FIG. 2 corresponds to the front side of the printer 1, and the left and right directions will be defined with reference to the front view of the printer 1, in the following description. In each of the drawings, U, Lo, L, R, Fr, and Rr indicate the upper, lower, left, right, front, and rear sides, respectively.

The printer 1 include a main body housing 3 having a rectangular parallelepiped shape. In the lower portion of the inside of the main body housing 3, a paper tray 4 on which sheets S are stored, and a paper feeding roller 5 that delivers the sheet S from the paper tray 4. On the upper side of the main body housing 3, a cover 3C is provided, so as to open and close about a hinge 3H located at the rear end portion. An image forming device 6 configured to form a toner image by electrophotography is provided on the upper side of the paper tray 4. On the upper side of the image forming device 6, a fixing device 7 that fixes the toner image onto the sheet S is provided. On the front side of the fixing device 7, a delivery roller 8 that delivers the sheet S, having the toner image fixed thereon, is provided. The cover 3C includes an output tray 9, on which the sheet S that has been delivered is stored.

Inside the main body housing 3, a transport route 10 extending from the paper feeding roller 5 to the delivery roller 8, via the image forming device 6 and the fixing device 7, is provided. The transport route 10 includes, as a main structure, plate-shaped members opposed to each other with a gap therebetween, to allow the sheet S to pass. On the transport route 10, a plurality of transport roller pairs 17, for pinching and transporting the sheet S, are located at predetermined positions along a transport direction Y. A resist roller pair 18 is provided at a position upstream of the image forming device 6, in the transport direction Y.

The image forming device 6 includes a photoconductor drum 11 that varies the potential with irradiation of light, a charging device 12 that charges the photoconductor drum 11 by discharging, an exposure device 13 that emits a laser beam based on image data, a developing device 14 that supplies a toner to the photoconductor drum 11, and a transfer roller 15 that generates a transfer bias.

The printer 1 also includes a controller 2, having an arithmetic device and a storage device. The arithmetic device is, for example, a central processing unit (CPU). The storage device includes a storage medium such as a read-only memory (ROM), a random-access memory (RAM), or an electrically erasable programmable read-only memory (EEPROM). The arithmetic device, serving as a processor, executes various operations by reading and executing control programs stored in the storage device. Here, the controller 2 may be constituted solely of an integrated circuit, without using software.

A display/operation device 19 is provided on the upper face of the main body housing 3. The display/operation device 19 includes an indicator lamp and push buttons. The controller 2 turns on the indicator lamp, according to the status of the printer 1. The controller 2 also controls each of the components of the printer 1, according to an instruction inputted with the push button.

Basically, the printer 1 performs the image forming operation as follows. When a printing job is inputted to the printer 1, for example from an external computer, the paper feeding roller 5 delivers the sheet S from the paper tray 4 to the transport route 10, and the resist roller pair 18 delivers the sheet S to the image forming device 6 at a predetermined timing, after correcting the skew of the sheet S while the rotation of the resist roller pair 18 is stopped. In the image forming device 6, the charging device 12 electrically charges the photoconductor drum 11 to a predetermined potential, the exposure device 13 writes the latent image on the photoconductor drum 11, the developing device 14 develops the latent image with the toner, thereby forming the toner image, and the transfer roller 15 transfers the toner image to the sheet S. Then the fixing device 7 fuses the toner image while pinching and transporting the sheet S, thereby fixing the toner image onto the sheet S, and the delivery roller 8 delivers the sheet S to the output tray 9.

Figure 3:
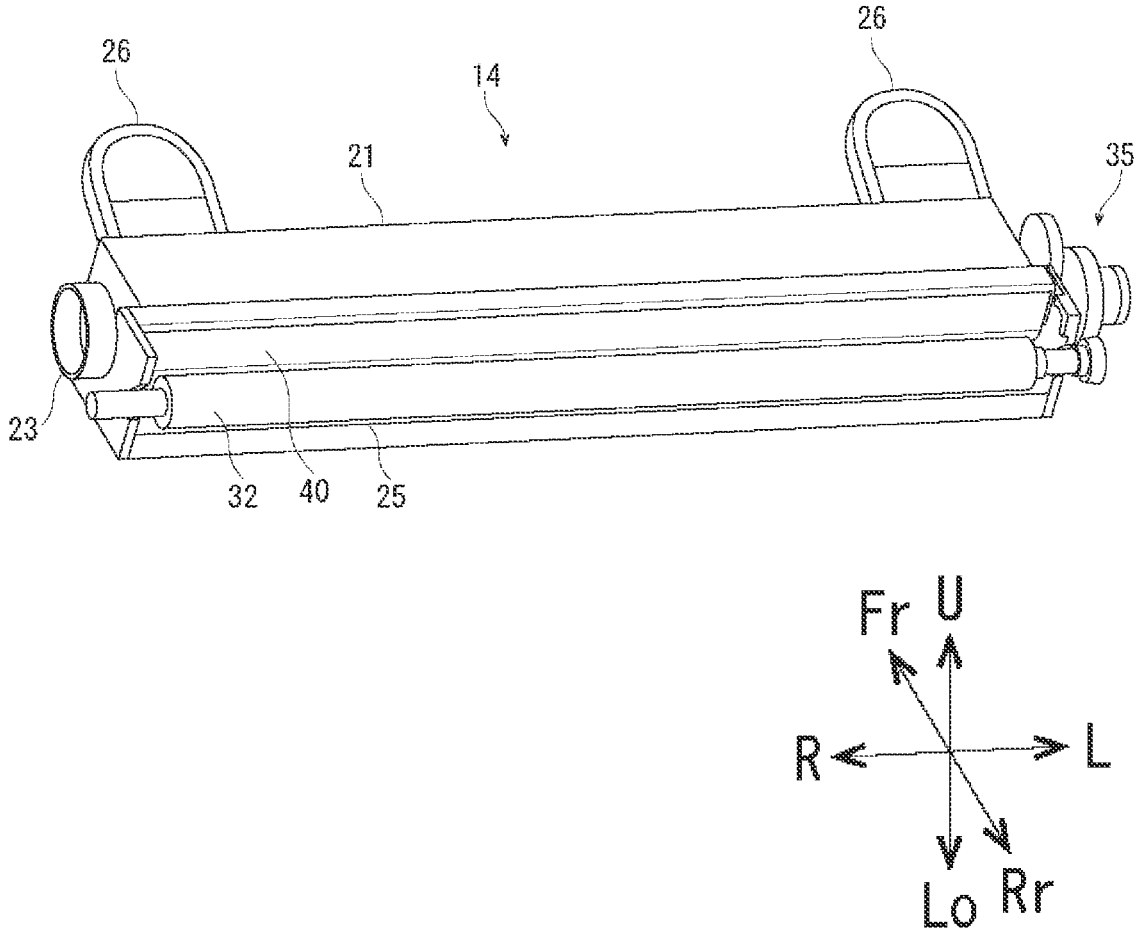
FIG. 3 is a perspective view showing the appearance of a developing device.
Figure 4:
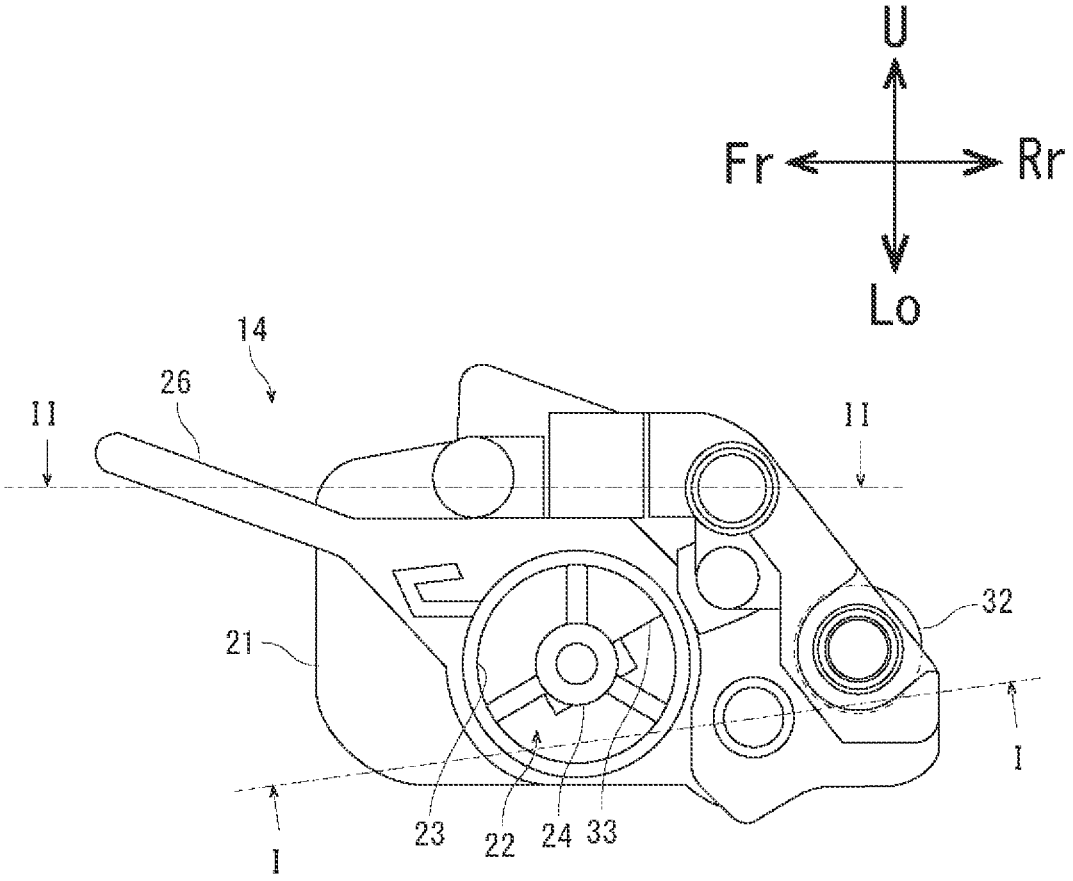
FIG. 4 is a right side view of the developing device.
Figure 5:
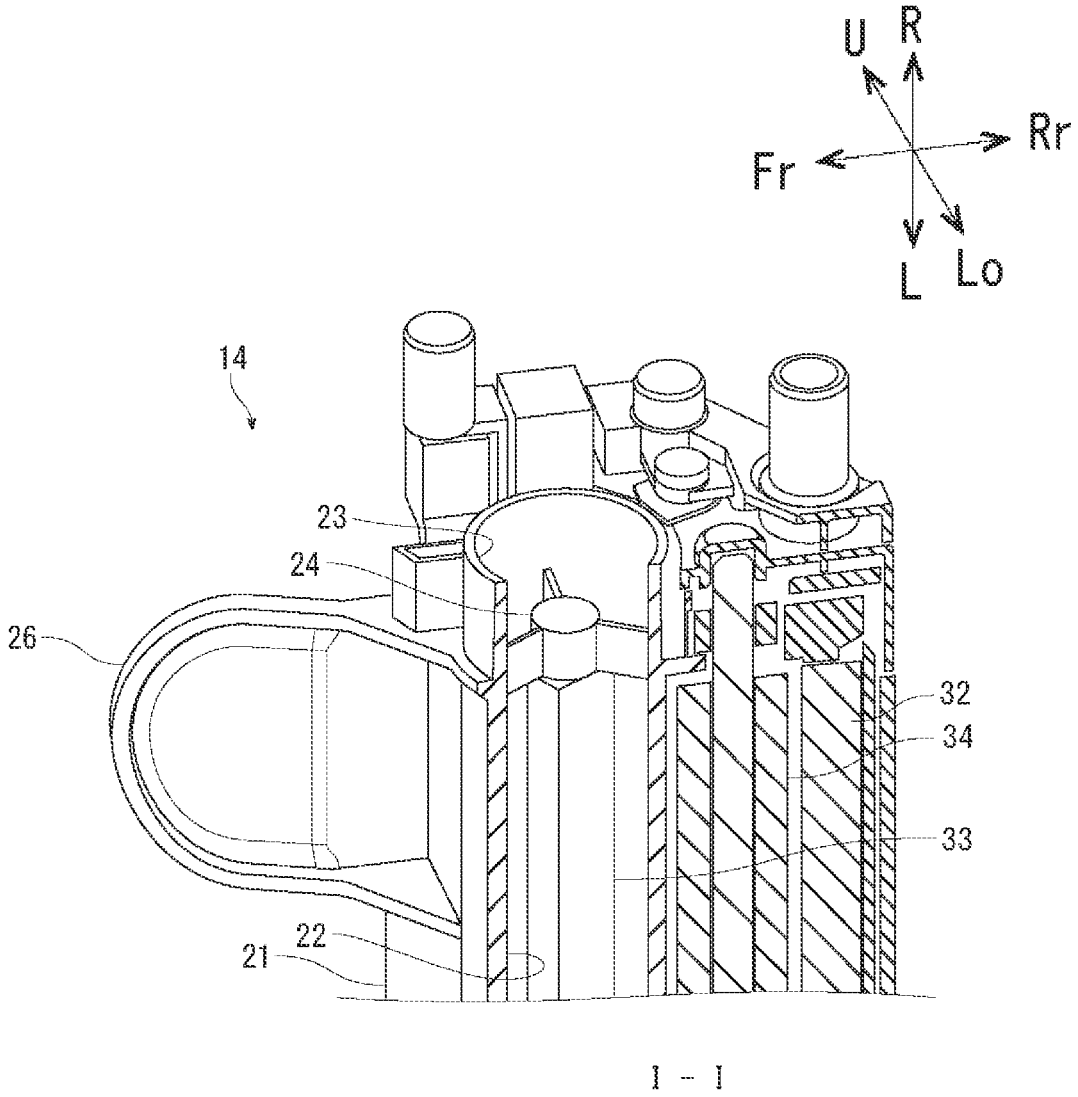
FIG. 5 is a perspective view showing a right end portion of the developing device.
Figure 6:
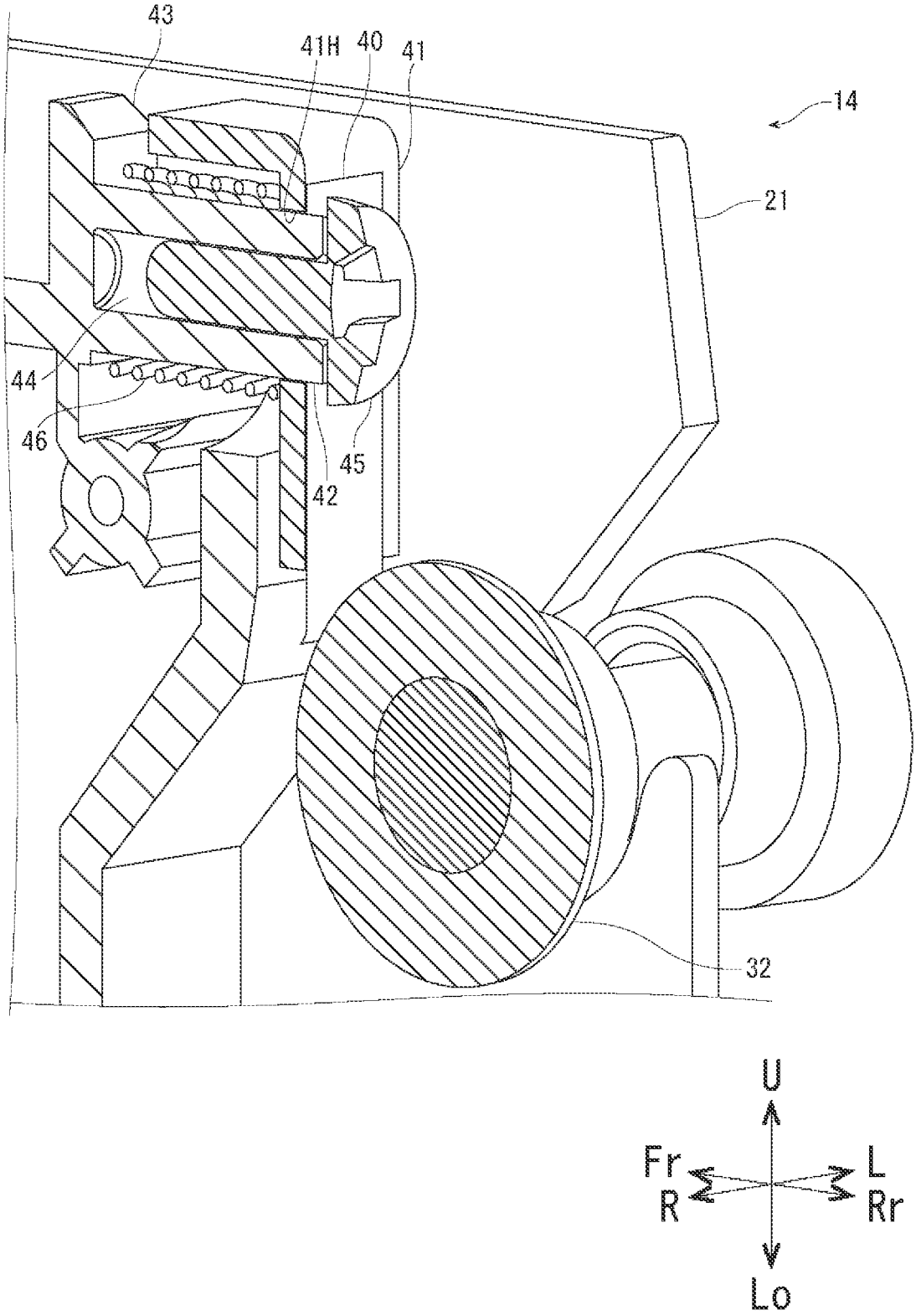
FIG. 6 is a perspective view showing an internal configuration of the developing device.

Hereunder, a configuration of the developing device 14 will be described. FIG. 3 is a perspective view showing the appearance of the developing device 14. FIG. 4 is a right side view of the developing device 14. FIG. 5 is a perspective view showing the right end portion of the developing device 14. FIG. 5 illustrates the cross-section taken along a line I-I in FIG. 4. FIG. 6 is a perspective view showing an internal configuration of the developing device 14. FIG. 6 illustrates the cross-section on the side of the left end portion of a developing roller 32. The structure on the side of the right end portion is the left-right inversion of the left end portion.

[Developing Device Housing]

A developing device housing 21 has a box shape elongate in the left-right direction. A handle 26 is provided on the front side of the developing device housing 21, at each of two positions in the left-right direction. The developing device housing 21 includes an opening 25 formed on the rear side, through which a part of the developing roller 32 is exposed.

[Stirring Chamber and Bladed Wheel]

In the bottom portion of the developing device housing 21, a stirring chamber 22 for storing a developing agent is provided. The stirring chamber 22 includes a bladed wheel 33, the axial line of which extends in the left-right direction. The bladed wheel 33 is, for example, a paddle. The bottom portion of the stirring chamber 22 is formed in a cylindrical shape, so as to accord with the locus of the tip portion of the blade of the bladed wheel 33.

[Developing Roller]

A supply roller 34 is provided on the rear side of the stirring chamber 22. The developing roller 32 is located on the rear side, and on the obliquely upper side, of the supply roller 34. A part of the outer circumferential surface of the developing roller 32 is exposed from the opening 25. The developing roller 32 includes a sleeve, and a permanent magnet located inside the sleeve. A gear train 35 is provided on the left end portion of the developing device housing 21. Driving force generated by a motor is transmitted to the developing roller 32, the bladed wheel 33, and the supply roller 34, via the gear train 35.

[Filling Inlet]

At the right end portion of the stirring chamber 22 (exemplifying the end portion of the stirring chamber 22 in the axial direction of the bladed wheel 33 in the disclosure), a filling inlet 23 is provided. The filling inlet 23 has a cylindrical shape open to the right side.

[Support Member]

A support member 24 supporting the shaft of the bladed wheel 33 is provided inside the filling inlet 23. The support member 24 includes a bearing and a plurality of support pillars. Three support pillars radially extend from the bearing at intervals of 120 degrees, thereby connecting between the bearing and the inner surface of the stirring chamber 22.

The developing agent contains, for example, a magnetic carrier and toner formed by sticking a color material to a resin. When the bladed wheel 33 stirs the developing agent, the carrier is frictionally charged. The supply roller 34 supplies the developing agent to the developing roller 32. On the outer circumferential surface of the developing roller 32, magnetic brush is generated by the developing agent. When the toner contained in the magnetic brush is adsorbed to the latent image on the photoconductor drum 11, the latent image is developed.

[Regulation Blade and Biasing Member]

A regulation blade 40 is a generally rectangular plate-shaped member, elongate in the left-right direction. The regulation blade 40 is located on the front side, and on the obliquely upper side, of the developing roller 32, such that the normal line extends generally in the front-rear direction. The lower end portion of the regulation blade 40 is curved to the opposite side of the outer circumferential surface of the developing roller 32. The regulation blade 40 is attached to a holder 41, located on the front side of the regulation blade 40. The holder 41 is a plate-shaped member, slightly wider than the regulation blade 40 in the left-right direction. The lower end portion of the holder 41 is located on the upper side of the lower end portion of the regulation blade 40. A holder hole 41H is provided, at an upper position of the holder 41 and the regulation blade 40, so as to penetrate therethrough in the front-rear direction.

The developing device housing 21 includes a holder guide 42 and a spring stopper 43. The holder guide 42 has a cylindrical shape, elongate in the front-rear direction. The outer diameter of the holder guide 42 is substantially equal to the holder hole 41H. The holder guide 42 includes a biasing member 46. The biasing member 46 is, for example, a compression coil spring located along the outer circumferential surface of the holder guide 42. The spring stopper 43, larger in size in the radial direction than the biasing member 46, is provided at the front end portion of the holder guide 42. The spring stopper 43 serves to restrict the biasing member 46 from moving to the front side. Here, the biasing member 46 may be, for example, a leaf spring or the like.

The holder 41 is located on the rear side of the biasing member 46, and the holder guide 42 is inserted in the holder hole 41H. A female thread 44 is formed on the inner surface of the holder guide 42. To the female thread 44, a male screw 45 is fastened. The diameter of the head of the male screw 45 is larger than the holder guide 42. The head of the male screw 45 serves to restrict the holder 41 from moving to the rear side.

Figure 7:
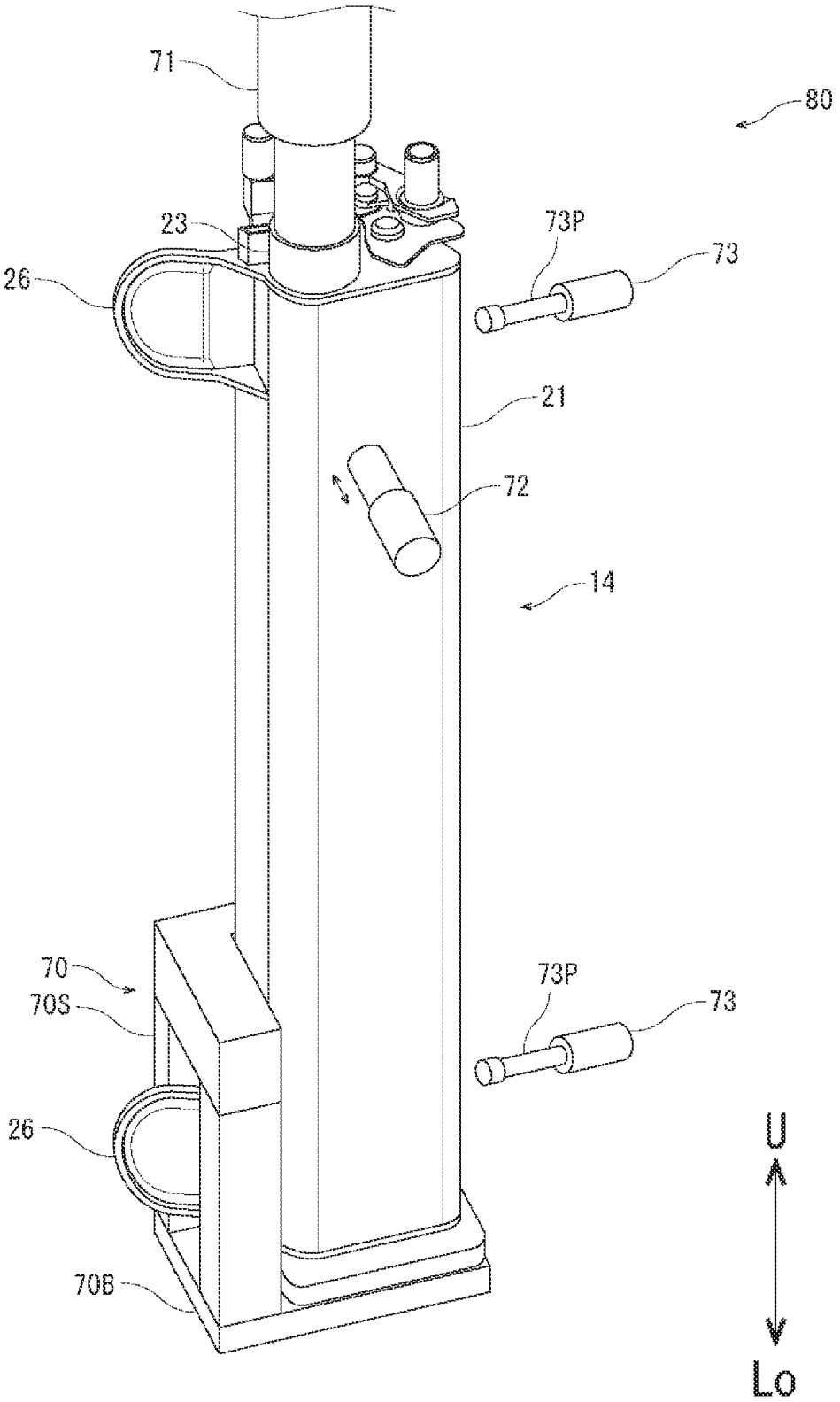
FIG. 7 is a perspective view showing the developing device retained by a jig.
Figure 8:
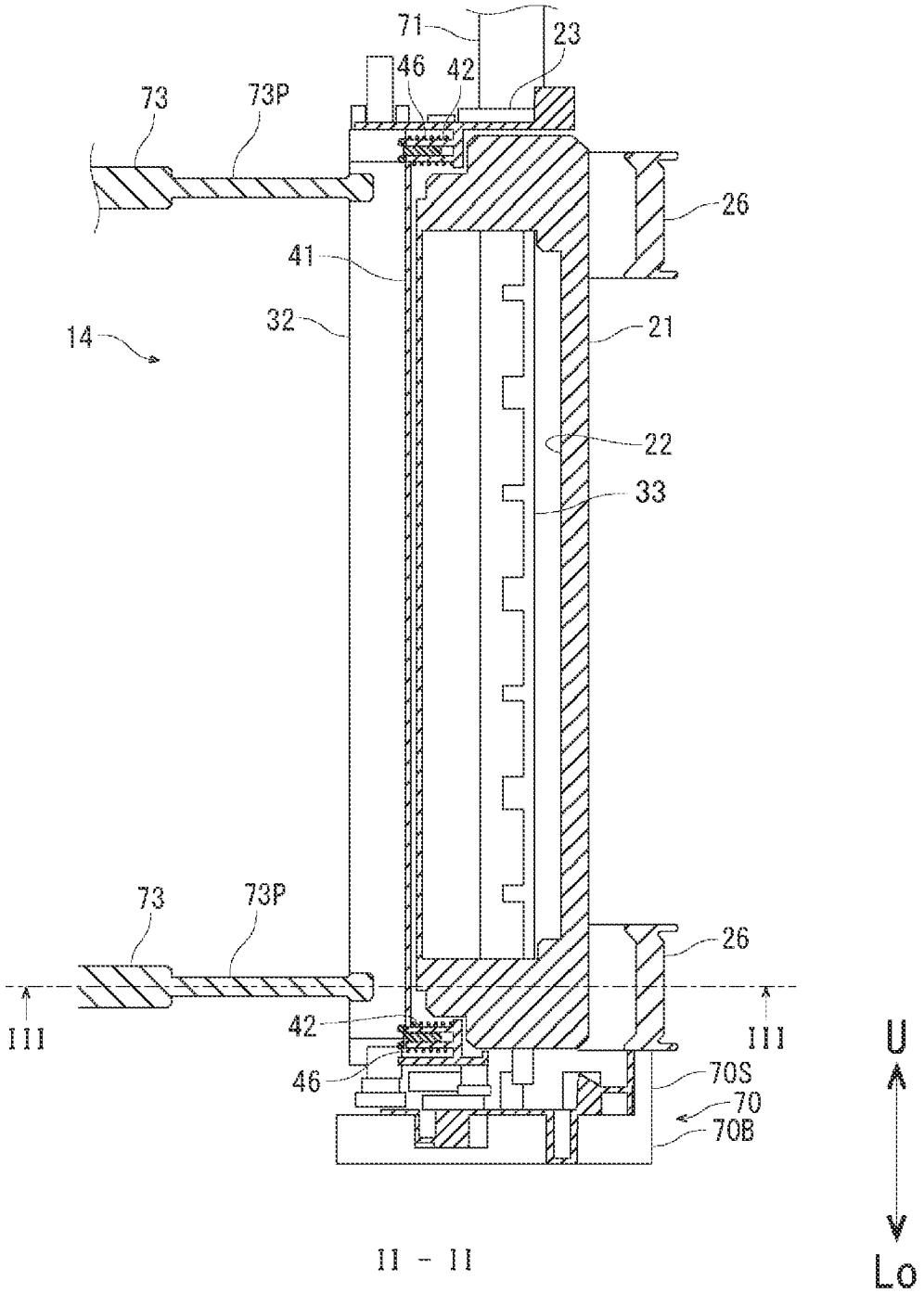
FIG. 8 is a cross-sectional view showing the developing device retained by the jig.
Figure 9:
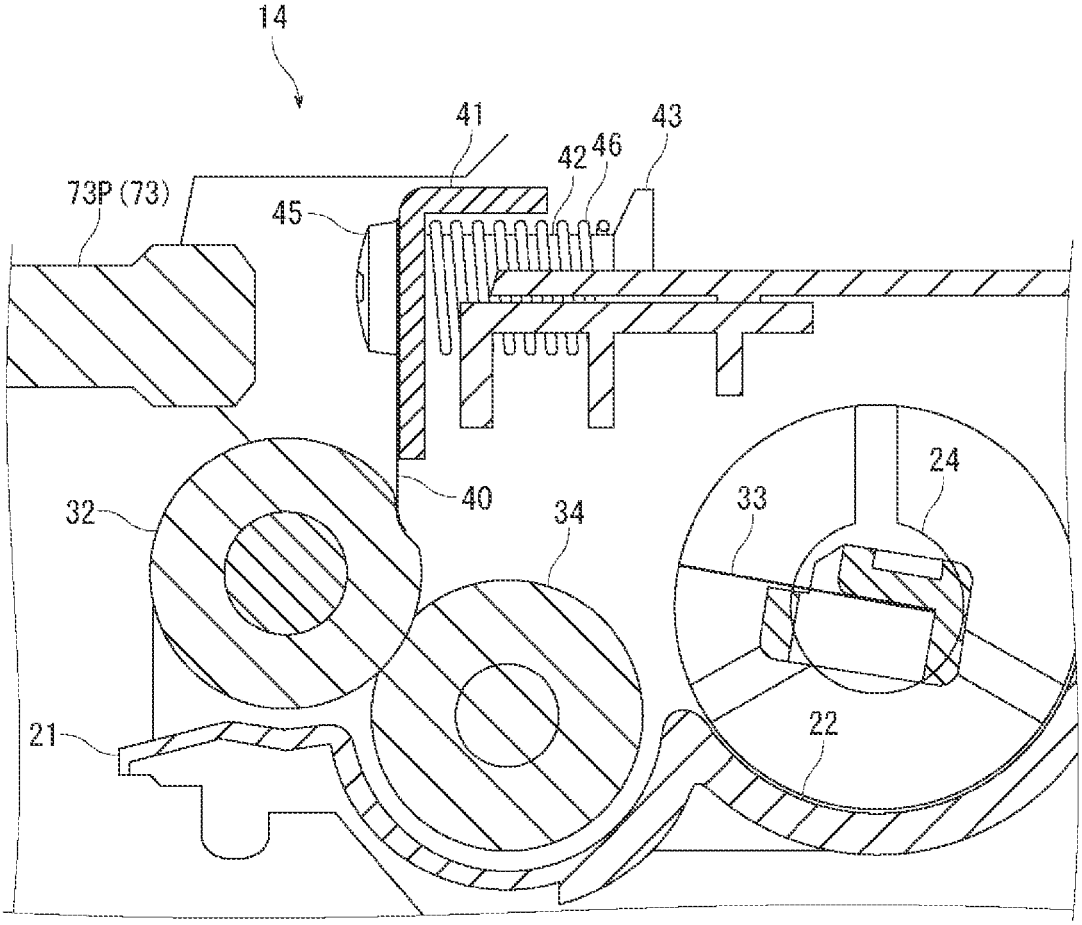
FIG. 9 is a cross-sectional view taken along a line III-III in FIG. 8.
Figure 10:
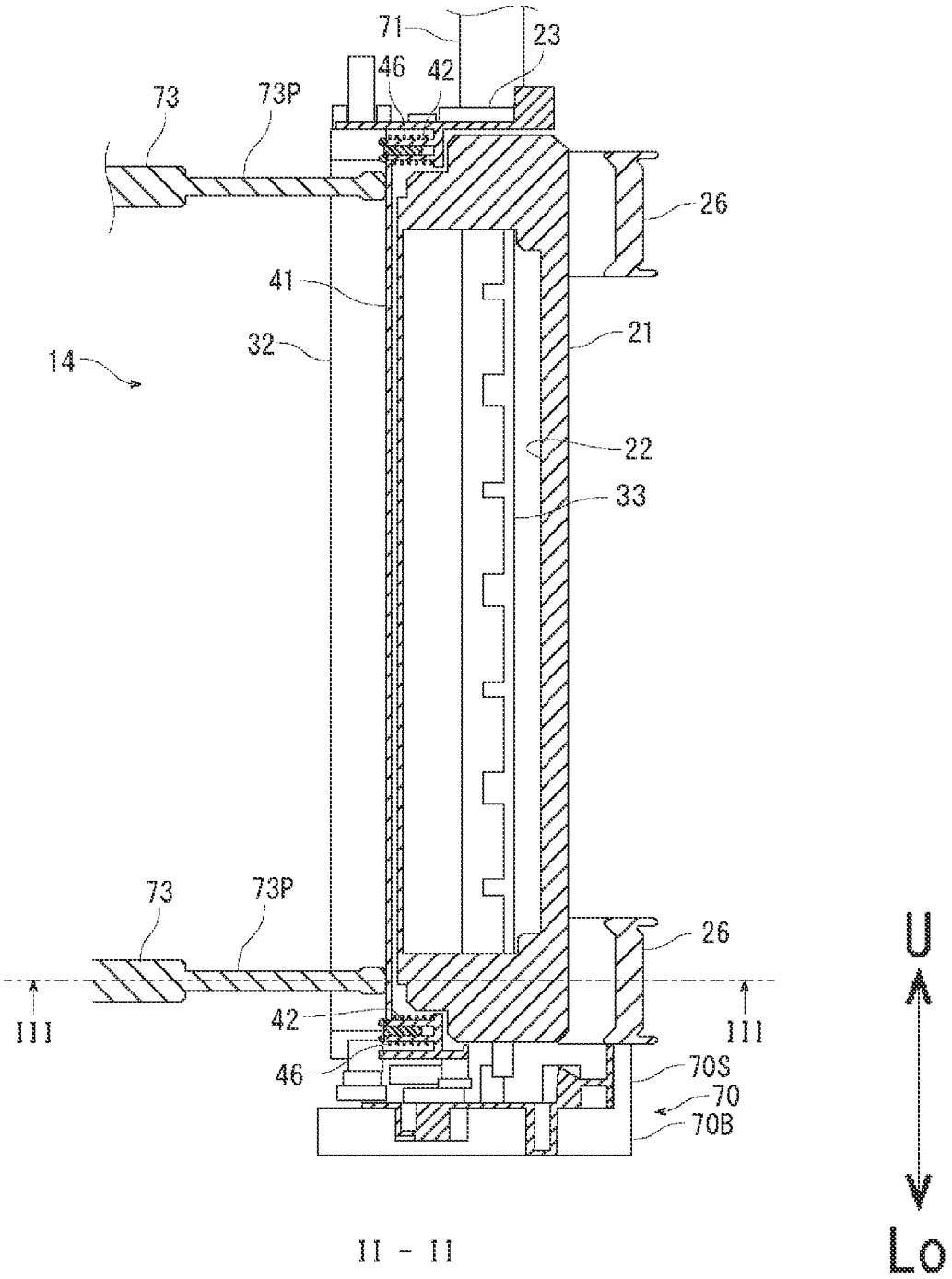
FIG. 10 is a cross-sectional view showing the developing device retained by the jig.
Figure 11:
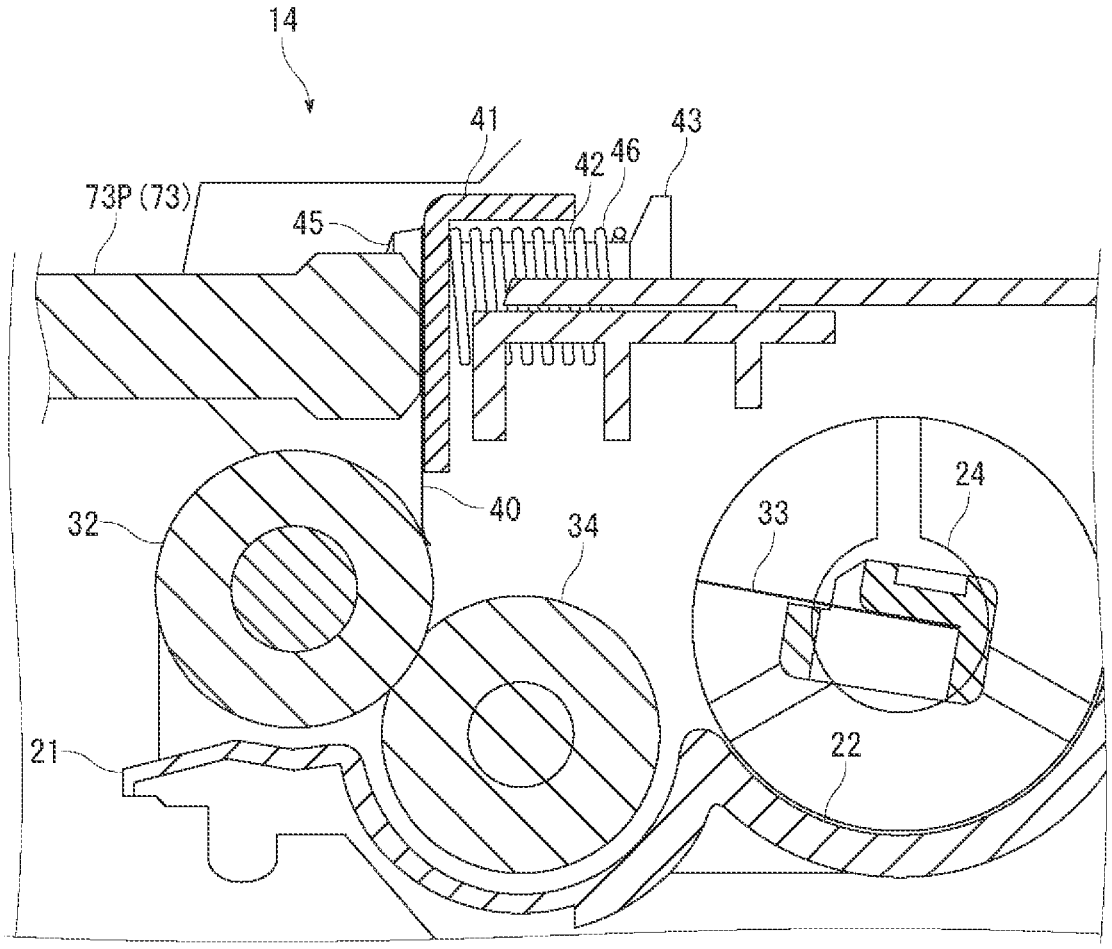
FIG. 11 is a cross-sectional view taken along a line III-III in FIG. 10.

Hereunder, description will be given regarding a developing agent filling device 80. FIG. 7 is a perspective view showing the developing device 14 retained by a jig 70. FIG. 8 and FIG. 10 are cross-sectional views each showing the developing device 14 retained by the jig 70. FIG. 8 and FIG. 10 are cross-sectional views taken along a line II-II in FIG. 4. FIG. 9 is a cross-sectional view taken along a line III-III in FIG. 8. FIG. 11 is a cross-sectional view taken along a line III-III in FIG. 10. FIG. 8 and FIG. 9 each illustrate the state where the regulation blade 40 is pressed against the developing roller 32. FIG. 10 and FIG. 11 each illustrate the state where the developing roller 32 is released from the pressure of the regulation blade 40.

The developing device 14 includes the stirring chamber 22 in which the developing agent is stored, the bladed wheel 33 that stirs the developing agent stored in the stirring chamber 22, the developing roller 32 that retains the developing agent stirred by the bladed wheel 33, the filling inlet 23 located at the end portion of the stirring chamber 22 in the axial direction of the bladed wheel 33, the support member 24 supporting the shaft of the bladed wheel 33 inside of the filling inlet 23, the regulation blade 40 opposed to the outer circumferential surface of the developing roller 32, and the biasing member 46 that presses the regulation blade 40 against the developing roller 32. The developing agent filling device 80 includes the jig 70 retaining the developing device 14 with the filling inlet 23 oriented upward, a pressure relief device 73 that releases the developing roller 32 from the pressure of the regulation blade 40, against the biasing member 46, and a vibration generating device 72 that vibrates the developing device 14.

[Jig]

The jig 70 sustains the lower portion of the developing device 14 (right end portion in FIG. 3), with the filling inlet 23 oriented upward. On the bottom portion 70B of the jig 70, protrusions and recesses are formed so as to correspond to the lower portion of the developing device 14. The side face 70S of the jig 70 serves to support the side face of the developing device 14, against the load imposed by the pressure relief device 73 and the vibration generated by the vibration generating device 72. The pressure relief device 73 and the vibration generating device 72 are supported by a frame unified with the jig 70.

[Pressure Relief Device]

The pressure relief device 73 is opposed to the regulation blade 40, at a position in the vicinity of each of the left and right holder guides 42. The pressure relief device 73 is an actuator (e.g., a solenoid actuator, a hydraulic cylinder, or a pneumatic cylinder), having a piston 73P that moves toward and away from the regulation blade 40. The piston 73P serves to push back the regulation blade 40, against the biasing member 46.

[Vibration Generating Device]

The vibration generating device 72 is a vibrator. The vibration generating device 72 is located so as to vibrate in a direction different from the moving direction of the pressure relief device 73. In the state shown in FIG. 7, for example, the vibration generating device 72 is in contact with the side face of the developing device 14 (bottom portion in FIG. 3). In other words, the vibration generating device 72 is located such that the moving direction of the pressure relief device 73 and the vibrating direction of the vibration generating device 72 become orthogonal to each other.

The developing agent filling device 80 includes an operation device for operating the pressure relief device 73 and the vibration generating device 72. When the operation device is operated, for example the controller 2 causes the piston 73P of the pressure relief device 73 to move back and forth, and causes the vibration generating device 72 to start and stop the vibration.

Hereunder, the filling operation of the developing agent will be described. The developing agent is filled in, when a new developing device 14 is shipped from a plant, and when the developing device 14 is recycled. The recycling of the developing device 14 refers to the case of collecting the developing device 14 in which the toner has run out from the user, refilling the developing device 14 with the developing agent at the plant, and delivering the developing device 14 to the user. The filling of the developing agent is performed as follows.

First, an operator mounts the developing device 14 on the jig 70, with the filling inlet 23 oriented upward. Since the pressure relief device 73 is not pushing the regulation blade 40 at this point (see FIG. 8 and FIG. 9), the developing device 14 assumes a pressed state, where the regulation blade 40 is pressed against the developing roller 32. In the pressed state, the surface of the developing roller 32 is slightly recessed, by the pressure of the regulation blade 40. In other words, the regulation blade 40 is intruding on the developing roller 32.

Then the operator causes the piston 73P of the pressure relief device 73 to move forward, by operating the operation device. Accordingly, the piston 73P pushes back the regulation blade 40 against the pressure of the biasing member 46 (see FIG. 10 and FIG. 11), the developing device 14 assumes a released state where the developing roller 32 is released from the pressure of the regulation blade 40. In the released state, the pressure relief device 73 pushes back the regulation blade 40, to the position where the regulation blade 40 is in contact with the developing roller 32, but not intruding thereon.

The operator then connects a container 71, accommodating therein the developing agent, to the filling inlet 23. The operator causes the developing agent to drop, while vibrating the developing device 14 with the vibration generating device 72. When a predetermined amount of the developing agent is filled in, the operator stops the operation of the vibration generating device 72, and causes the piston 73P of the pressure relief device 73 to move backward. Accordingly, the pressure relief device 73 no longer pushes the regulation blade 40 (see FIG. 8 and FIG. 9), and the developing device 14 assumes the pressed state. The operator removes the container 71 of the developing agent, closes the filling inlet 23, and removes the developing device 14 from the jig 70.

Now, a developing device that also serves as a developing agent cartridge is known. In this case, the developing device filled with the developing agent is supplied to the user, and when the developing agent runs out owing to the printing operation, the developing device is replaced with another one filled with the developing agent. The empty developing device is collected and refilled with the developing agent at the plant, and then supplied to the user.

Regarding the filling of the developing agent, some issues have to be addressed, with respect to the following configuration. As described above, the bladed wheel is provided in the stirring chamber of the developing device. The filling inlet, having the opening oriented in the axial direction, is provided at the end portion of the stirring chamber in the axial direction the bladed wheel. The developing device is fixed on the jig with the filling inlet oriented upward, and the container accommodating therein the developing agent is connected to the filling inlet, so that the developing agent is dropped into the filling inlet. However, the support member supporting the shaft of the bladed wheel is provided inside the filling inlet, and therefore the developing agent falls on the support member, and is deposited thereon.

To prevent the developing agent from residing on the support member, the vibrator may be employed, to vibrate the developing device fixed on the jib, while dropping the developing agent. However, in the case where the regulation blade remains pressed against the developing roller, the surface of the developing roller may be damaged, owing to the friction between the regulation blade and the developing roller.

To prevent the damage on the developing roller, it is useful to move the regulation blade away from the developing roller. The aforementioned existing developing device is configured to move the regulation blade away from the developing roller. However, the operator has to hold the regulation blade with the hand, during the filling operation of the developing agent. Moreover, the existing developing device is configured to move the regulation blade, for example using an electric magnet, a motor and a cam, and a shape memory alloy, and therefore the configuration of the developing device has to be modified.

According to the foregoing embodiment, in contrast, the developing agent filling device 80 includes the jig 70 retaining the developing device 14 with the filling inlet 23 oriented upward, the developing device 14 including the stirring chamber 22, the bladed wheel 33 that stirs the developing agent stored in the stirring chamber 22, the developing roller 32 that retains the developing agent stirred by the bladed wheel 33, the filling inlet 23 located at the end portion of the stirring chamber 22 in the axial direction of the bladed wheel 33, the support member 24 supporting the shaft of the bladed wheel 33 inside of the filling inlet 23, the regulation blade 40 opposed to the outer circumferential surface of the developing roller 32, and the biasing member 46 that presses the regulation blade 40 against the developing roller 32, the pressure relief device 73 that releases the developing roller 32 from the pressure of the regulation blade 40, against the biasing member 46, and the vibration generating device 72 that vibrates the developing device 14. The mentioned configuration enables the developing agent to be filled in, with the developing roller 32 released from the pressure of the regulation blade 40 while the vibration is being applied, without the need to modify the configuration of the developing device 14.

According to the foregoing embodiment, the pressure relief device 73 is the actuator having the piston 73P that pushes back the regulation blade 40 against the biasing member 46. Therefore, the developing roller 32 can be easily released from the pressure of the regulation blade 40.

According to the foregoing embodiment, the pressure relief device 73 pushes back the regulation blade 40 to the position where the regulation blade 40 is in contact with the developing roller 32, but not intruding thereon. Accordingly, the stroke of the pressure relief device 73 can be minimized, which leads to reduced energy consumption.

According to the foregoing embodiment, the pressure relief device 73 and the vibration generating device 72 are located such that the moving direction of the pressure relief device 73 and the vibrating direction of the vibration generating device 72 become different from each other. In the case where the pressure relief device 73 moves in the same direction as the vibration of the vibration generating device 72, the developing roller 32 may be damaged owing to repeated actions of pressing and moving away of the regulation blade 40. Since the moving direction of the pressure relief device 73 and the vibrating direction of the vibration generating device 72 are different from each other in the embodiment, the regulation blade 40 can be suppressed from pressing the developing roller 32, when the vibration is applied to the developing device 14, and therefore the developing roller 32 can be prevented from being damaged.

According to the foregoing embodiment, the pressure relief device 73 and the vibration generating device 72 are located such that the moving direction of the pressure relief device 73 and the vibrating direction of the vibration generating device 72 become orthogonal to each other. With such a configuration, the regulation blade 40 can be suppressed from pressing the developing roller 32, when the vibration is applied to the developing device 14, and therefore the developing roller 32 can be prevented from being damaged.

The foregoing embodiment may be modified as the following variations.

For example, a clamp that holds the developing device 14 in the left-right direction may be employed as the pressure relief device 73, instead of the actuator. For example, the clamp may be attached so as to hold the developing device 14, at two points including the position where the piston 73P is made to contact, according to the embodiment, and the position in the vicinity of the handle 26. In this case also, the developing roller 32 can be prevented from being damaged.

Figure 12:
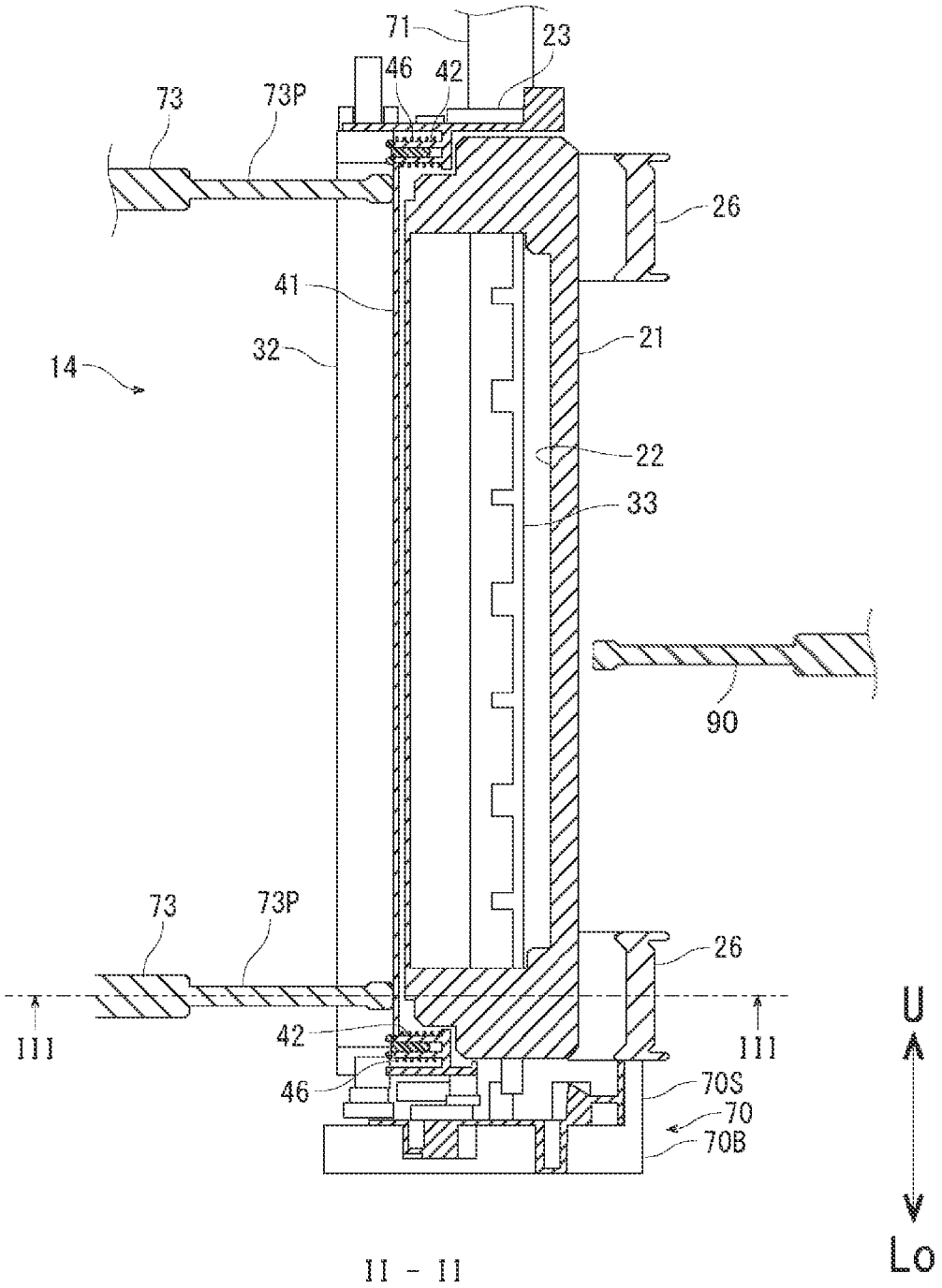
FIG. 12 is a cross-sectional view showing an actuator pushing back a developing device housing.

In addition to the configuration according to the foregoing embodiment, an actuator 90 (see FIG. 12) may be provided, so as to press the developing device housing 21 (i.e., developing device 14) in the direction opposite to the direction in which the pressure relief device 73 pushes back the regulation blade 40. For example, such actuator may be located, for example, in the vicinity of the handle 26 on the upper side in FIG. 7. In this case, the developing device 14 can be prevented from tilting, because of the forward movement of the piston 73P of the pressure relief device 73.

Further, the disclosure may be defined as a developing agent filling method, including a step of mounting the developing device 14 on the jig 70, with the filling inlet 23 oriented upward, the developing device 14 including the stirring chamber 22, the bladed wheel 33 that stirs the developing agent stored in the stirring chamber 22, the developing roller 32 that retains the developing agent stirred by the bladed wheel 33, the filling inlet 23 located at the end portion of the stirring chamber 22 in the axial direction of the bladed wheel 33 and opened in the axial direction, the support member 24 supporting the shaft of the bladed wheel 33 inside of the filling inlet 23, the regulation blade 40 opposed to the outer circumferential surface of the developing roller 32, and the biasing member 46 that presses the regulation blade 40 against the developing roller 32, a step where, for example, the controller 2 releases the developing roller 32 from the pressure of the regulation blade 40 using the pressure relief device 73, against the biasing member 46, and a step where, for example, the controller 2 fills the developing device 14 with the developing agent through the filling inlet 23, while vibrating the developing device 14 using the vibration generating device 72.

While the present disclosure has been described in detail with reference to the embodiments thereof, it would be apparent to those skilled in the art the various changes and modifications may be made therein within the scope defined by the appended claims.

What is claimed is:

1. A developing agent filling device comprising:

a jig retaining a developing device with a filling inlet oriented upward, the developing device including a stirring chamber, a bladed wheel that stirs a developing agent stored in the stirring chamber, a developing roller that retains the developing agent stirred by the bladed wheel, the filling inlet located at an end portion of the stirring chamber in an axial direction of the bladed wheel and opened in the axial direction, a support member supporting a shaft of the bladed wheel inside of the filling inlet, a regulation blade opposed to an outer circumferential surface of the developing roller, and a biasing member that presses the regulation blade against the developing roller;

a pressure relief device that releases the developing roller from a pressure of the regulation blade against the biasing member; and a vibration generating device that vibrates the developing device.

2. The developing agent filling device according to claim 1, wherein the pressure relief device includes an actuator having a piston that pushes back the regulation blade against the biasing member.

3. The developing agent filling device according to claim 2, further comprising an actuator that presses the developing device in a direction opposite to a direction in which the pressure relief device pushes back the regulation blade.

4. The developing agent filling device according to claim 1, wherein the pressure relief device pushes back the regulation blade to a position where the regulation blade is in contact with the developing roller, but not intruding thereon.

5. The developing agent filling device according to claim 1, wherein the pressure relief device and the vibration generating device are located such that a moving direction of the pressure relief device and a vibrating direction of the vibration generating device become different from each other.

6. The developing agent filling device according to claim 5, wherein the pressure relief device and the vibration generating device are located such that a moving direction of the pressure relief device and a vibrating direction of the vibration generating device become orthogonal to each other.

7. A developing agent filling method comprising:

mounting a developing device on a jig with a filling inlet oriented upward, the developing device including a stirring chamber, a bladed wheel that stirs a developing agent stored in the stirring chamber, a developing roller that retains the developing agent stirred by the bladed wheel, the filling inlet located at an end portion of the stirring chamber in an axial direction of the bladed wheel and opened in the axial direction, a support member supporting a shaft of the bladed wheel inside of the filling inlet, a regulation blade opposed to an outer circumferential surface of the developing roller, and a biasing member that presses the regulation blade against the developing roller;

releasing the developing roller from a pressure of the regulation blade using a pressure relief device against the biasing member; and filling the developing device with the developing agent through the filling inlet, while vibrating the developing device using a vibration generating device.

* * * * *